US006953485B2

(12) United States Patent
Gardner et al.

(10) Patent No.: US 6,953,485 B2
(45) Date of Patent: Oct. 11, 2005

(54) ENHANCED FABRIC COMPRISING SUBSTRATES AND PROCESS TO PROVIDE SAME

(75) Inventors: Robb Richard Gardner, Cincinnati, OH (US); Janet Sue Littig, Fairfield, OH (US); Mark Robert Sivik, Mason, OH (US)

(73) Assignee: Strike Investments, LLC, Loveland, OH (US)

( * ) Notice: Subject to any disclaimer, the term of this patent is extended or adjusted under 35 U.S.C. 154(b) by 168 days.

(21) Appl. No.: 09/778,678

(22) Filed: Feb. 7, 2001

(65) Prior Publication Data

US 2001/0049244 A1 Dec. 6, 2001

Related U.S. Application Data

(60) Provisional application No. 60/180,594, filed on Feb. 7, 2000.

(51) Int. Cl.[7] ..... D06Q 1/00; D06M 11/00; B32M 27/04; B05D 3/02; B05D 3/04

(52) U.S. Cl. ..... 8/115; 442/102; 442/104; 442/106; 442/107; 442/109; 442/148; 442/103; 252/8.81; 427/385; 427/389.9

(58) Field of Search ..... 442/102, 104, 442/106, 109, 148, 120, 103, 107, 160; 8/115.5; 252/8.87; 427/389.9

(56) References Cited

U.S. PATENT DOCUMENTS

| | | | | |
|---|---|---|---|---|
| 2,486,399 A | | 11/1949 | Gagarine | |
| 2,679,449 A | | 5/1954 | Schappel | |
| 2,785,947 A | | 3/1957 | Kress | |
| 2,785,949 A | | 3/1957 | Kress | |
| 2,785,996 A | | 3/1957 | Kress | |
| 2,786,081 A | | 3/1957 | Kress | |
| 2,885,443 A | | 5/1959 | Kress | |
| 2,903,328 A | | 12/1959 | Kress | |
| 3,046,079 A | | 7/1962 | Reeves et al. | |
| 3,427,121 A | | 2/1969 | Frick, Jr. et al. | |
| 3,434,794 A | | 3/1969 | Tovey | |
| 3,441,366 A | | 4/1969 | Pierce et al. | |
| 3,852,829 A | * | 12/1974 | Cicione et al. | 8/182 |
| 3,871,822 A | * | 3/1975 | Goodman et al. | 8/187 |
| 4,207,073 A | * | 6/1980 | Petersen et al. | 8/187 |
| 4,472,167 A | | 9/1984 | Welch | |
| 4,780,102 A | | 10/1988 | Harper, Jr. | |
| 4,851,291 A | | 7/1989 | Vigo et al. | |
| 4,908,238 A | | 3/1990 | Vigo et al. | |
| 5,897,952 A | | 4/1999 | Vigo et al. | |

FOREIGN PATENT DOCUMENTS

| | | |
|---|---|---|
| JP | 05059664 | 3/1993 |
| WO | WO 87/07854 | 12/1987 |
| WO | WO 99/58758 | 11/1999 |

OTHER PUBLICATIONS

Temperature–Adaptable Textiles Containing Durably Bound Polyethylene Glycols Aug. 25, 1986; pp. 427–429.

Abrasion and Lint Loss Properties of Fabrics Containing Crosslinked Polyethylene Glycol George E.R. Lamb. et al.; Mar., 1991; pp. 169–176.

Cotton Crossed–Linked at Various Degrees of Fiber Swelling Wilson A. Reeves et al., Mar. 1960; pp. 179–192.

Influence of Formaldehyde Concentration on the Cross–Links Introduced into Cotton Cellulose Jul. 1, 1963; pp. 955–958.

* cited by examiner

*Primary Examiner*—Terrel Morris
*Assistant Examiner*—Lynda Salvatore
(74) *Attorney, Agent, or Firm*—Donald E. Hasse; Hasse & Nesbitt LLC

(57) ABSTRACT

The present invention relates to substrate comprising fabric, the substrate treated with a composition comprising:

a) formaldehyde;

b) polyethylene glycol having a molecular weight of from about 700 gm/mol to about 2500 gm/mol; and c) an acid catalyst;

wherein the treated substrate has at least three enhanced fabric benefits, said benefits selected from the group consisting of:

i) durable press;
ii) hand feel;
iii) anti-abrasion;
iv) anti-shrinkage; and
v) anti-yellowing.

The present invention further relates to a system and a process for providing a substrate having the above described enhanced fabric benefits.

22 Claims, No Drawings

ENHANCED FABRIC COMPRISING SUBSTRATES AND PROCESS TO PROVIDE SAME

CROSS REFERENCE TO RELATED APPLICATIONS

This application claims priority to U.S. Provisional Application Ser. No. 60/180,594 filed Feb. 7, 2000.

FIELD OF THE INVENTION

The present invention relates to a system for enhancing the properties of substrates, which comprise woven and non-woven fabric fibers. The substrates treated by the systems of the present invention have at least three enhanced properties either relative to untreated substrates or relative to prior art processes.

BACKGROUND OF THE INVENTION

Of all the various articles of manufacture, aside from those related to simple machines, articles comprising fabric are most ubiquitous and have been known since antiquity. These articles of manufacture, which comprise fabric are most readily found in the form of substrates, inter alia, clothing (apparel), furniture surfaces, shoelaces, draperies. The fabric comprising said substrates can be either natural material, for example, cotton, wool, and the like, or synthetic material, for example, polyester. The substrates can be rigid, flexible, a combination of both.

Important among substrates comprising fabric are articles of manufacture, which relate to clothing and other forms of wearing apparel. Manufacturers have used natural, synthetic, and mixtures thereof to form modem fibers that comprise the fabric. For wearing apparel per se, cotton is both functional and comfortable, thereby providing an inexpensive, renewable source of material. Synthetic fibers, alone or admixed with natural fibers, provide durability and wear properties, which are an improvement over fully natural fabric. For example, certain synthetic fabrics and blends do not exhibit the propensity to wrinkle like cotton. Nor do synthetic fabrics stain in the manner that natural fabrics stain.

Substrates comprising fabric can be classified into two categories: those comprising units having reactable units, inter alia, cotton, and those which have non-reactive or less reactive units, inter alia, polyester. For example, the hydroxyl units that comprise the polysaccharides of cotton can react with foreign substrates, i.e. food, dirt, oils, to form stains of varying durability. Therefore, fabric having these reactable units can become easily adulterated. This adulteration can profoundly affect the aesthetic form of the fabric, for example, color staining. However, fabric can also have bulk properties, which are directly related to its chemical structure, the most prevalent being the tendency of natural fibers, inter alia, cotton, rayon and wool, to shrink.

Manufacturers of substrates comprising fabric have attempted to make use of the reactable nature of some fibers to imbue desirable properties into the final substrates. Permanent press cotton clothing is one example of modifying fabric to provide a benefit. Others include stain resistance, flame retardance, and enhanced whiteness (optical brightness). However, these improvements can have offsetting consequence. For example, many of the processes that apply permanent press modifiers are conducted under strongly acidic conditions, conditions which cause 50% or more of the natural fiber strength to be lost. In addition, fabric properties which are enhanced may be short-lived, and when this fact is coupled with, in many instances, diminished fiber strength, the overall effect is a lessening of the overall fabric quality. Also, the addition of anti-static or softening agents can change the softness profile of fabric thereby increasing the tendency of fabric to prematurely abrade.

There is a long felt need for a fabric comprising substrate having enhanced properties which do not sacrifice one desirable property in order to obtain one or more other desirable fabric properties.

SUMMARY OF THE INVENTION

The present invention meets the aforementioned needs in that it has been surprisingly discovered that substrates which comprise fabric can have the fibers of said fabric modified in such a manner that a substrate is formed which has an enhancement of at least three fabric properties without the loss of any other desirable characteristics. The substrates of the present invention comprise fabric that has been treated at the point of manufacture or during the process of manufacturing fibers, which comprise said fabric. In addition, it is a property of the substrates of the present invention that the enhanced desirable properties are sustained during the useful life of said substrates and that the increase in these properties is not accomplished at the expense of fabric or fiber character, inter alia, strength, color, hydrophilicity.

The first aspect of the present invention relates to a substrate comprising fabric, the substrate treated with a composition comprising:

a) formaldehyde;

b) polyethylene glycol having a molecular weight of from about 700 gm/mol to about 2500 gm/mol; and c) an acid catalyst;

wherein the treated substrate has at least three enhanced fabric benefits, said benefits selected from the group consisting of:

i) durable press;

ii) hand feel;

iii) anti-abrasion;

iv) anti-shrinkage; and v) anti-yellowing.

The subject matter of the present invention is not limited to substrates but to any article of manufacture which comprises fibers which can be treated with the benefit enhancing compositions. To this end, the present invention also relates to an article of manufacture comprising fabric made up of woven or non-woven fibers, the fibers having at least three enhanced fabric benefits, said benefits selected from the group consisting of:

i) durable press;

ii) hand feel;

iii) anti-abrasion;

iv) anti-shrinkage; and v) anti-yellowing;

wherein said benefits are achieved by treating said fibers with a composition comprising:

a) formaldehyde;

b) polyethylene glycol having a molecular weight of from about 700 gm/mol to about 2500 gm/mol; and c) an acid catalyst.

One further embodiment of the present invention enhances four of the hereinabove identified fabric benefits, while another embodiment is capable of enhancing each of the fabric benefits. Other embodiments of the present invention provide at least three of the benefits while enhancing other benefits, inter alia, water absorbency, fire retardance.

The present invention further relates to systems and processes for applying to fabric or fibers, which are to be formed into fabric, the compositions of the present invention wherein said fabric is subsequently used to form a substrate.

These and other objects, features, and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The substrates of the present invention comprise fabric, which has been treated in a manner which enhances three or more identified fabric properties. The manner in which the fabric is treated obviates the problems, which have existed in the prior art, namely, preserving all the desirable properties of fabric, or the fibers comprising said fabric, while selectively enhancing other properties.

The present invention relates to the fabric properties or benefits selected from the group consisting of:

i) durable press;

ii) hand feel;

iii) anti-abrasion;

iv) anti-shrinkage; and v) anti-yellowing.

It has now been surprisingly discovered that fabrics comprising reactable moieties can be treated with a composition which provides at least three of the above-identified fabric benefits while maintaining the balance of the listed properties. In other variations and embodiments of the present invention, four and five of the benefits are enhanced. In yet other embodiments at least three of the above-identified properties are enhanced while not diminishing other desirable, but not enumerated properties of fabric or fiber.

For the purposes of the present invention the fabric, which comprises the substrates described herein, are composed of fibers divided into three categories.

The first of these categories is "naturally occurring" or "natural" fibers. Non-limiting examples of natural fibers includes cotton, wool, silk, flax, jute, ramie, and the like. These naturally occurring fibers may be processed in any manner necessary to prepare the materials for use in fabricating a substrate.

The second category of fibers relates to synthetic fibers. Non-limiting examples of synthetic fibers includes rayon, nylon, polyester, and the like. A third category relates to fabric that is a mixture of "natural fibers" and "synthetic fibers" to yield "blended fibers."

Central to one or more embodiments of the present invention is the treatment of cellulosic fiber, which comprises "cellulosic material." For the purposes of the present invention the term "cellulosic material" is defined as "fibrous cellulose comprising-material derived from native sources, inter alia, cotton, flax, including the pulp of said sources, inter alia, wood pulp; cellulose comprising derivatives, non-limiting examples of which include cellulose acetates, cellulose ethers". "Cellulosic material" depending upon the context is defined as "the raw material, inter alia, fibers, or the finished product, inter alia, an article of clothing". The term "cellulose fabric" is used interchangeably for and is meant to stand equally well for "fabric comprising 100% cotton fiber, and mixtures of cotton fiber and synthetic fibers."

The substrates of the present invention may be "knitted", "woven" or "unwoven" substrates. Typically "woven" and "knitted" substrates are fabricated from fibers that are prepared from natural sources, inter alia, cotton fibers or wool fibers. Non-woven substrates may include substrates which fibers are a web or batt of fibers bound by the application of heat, entanglement, and/or pressure.

The following is a definition of the fabric properties or benefits provided by the present invention.

Durable Press

Durable Press relates to the property of fabric to retain a shape, for example, a crease in pants or trousers, and not to manifest wrinkles. Durable Press is determined by applying American Association of Textile Chemists and Colorists (AATCC) Method 124-1996. The Durable Press benefit is defined as fabric having a durable press (DP) rating of at least about 3 after 1 washing. Other embodiments provide a rating of at least about 3 after 5 washings. Yet other embodiments of the present invention provide the substrate with a DP rating of at least about 3.25 after 1 washing. Yet another embodiment maintains the DP of 3.25 after 5 machine washings. For the purposes of the present invention term "washing" relates to treating said substrate with an aqueous solution composition comprising at least 0.001% by weight, of a detersive surfactant. The washing can be done manually or by appliance (machine washing).

The present invention further relates to substrates which have a DP rating of at least about 3.5 after 1 machine wash while this embodiment also includes substrates having a DP rating of at least about 3.5 after 5 machine washings.

Hand Feel

Hand feel relates to the smoothness or softness of fabric, which forms a substrate. Although intuitively a subjective parameter, there are nevertheless instruments which can provide softness measurements, as well as American Association of Textile Chemists and Colorists (AATCC) Methods, inter alia, EP-5, "Fabric Hand: Guidelines for the Subjective Evaluation of" to provide objective standards for evaluating Hand Feel. These guidelines include using various parts of the hand to touch, squeeze, rub, or otherwise handle treated fabric.

Included within the instrument measurements are the Kawabata Evaluation Instruments: tensile/shear tester, bending tester, compression tester, surface friction tester. Also important is the KES-SE Friction Tester from which is obtained a coefficient of friction measurement, the Taber V-5 Stiffness Tester, and the TRI Softness Tester.

The units which measure increased hand feel are dimensionless and depend upon the type of system employed. For substrates treated with the compositions of the present invention, no change in hand feel from the untreated fabric is considered according to the present invention to be providing a benefit since treatment of fabric typically reduces the quality of hand feel.

Anti-Abrasion

Anti-abrasion is a benefit, which is a "retained" benefit and as such is not measured against an untreated substrate. Treatment of a fabric fiber comprising substrate in a process will degrade the natural strength present in the substrate. Therefore, the present system measures the criteria of anti-abrasion relative to a prior art process, typically, treatment of a substrate with formaldehyde alone. The loss of anti-abrasion properties of the present systems is less than that found after treatment with formaldehyde.

Anti-abrasion properties relate to substrates wherein the fabric which forms said substrate comprises fibers, which have reduced mechanical breakage or fracture thereby having a reduced "roughness" or "abrasive" feel. The level of Anti-Abrasion as it relates to the substrates of the present invention, is determined by the Nu-Martindale Abrasion Tester (Martindale). The parameters measures by the Martindale method include fiber weight loss and number of cycles to induce fabric hole formation.

The following is a description of the Martindale method according to the present invention.

I Sample Preparation a) Equilibrate fabric a constant temperature (approx. 70° F.) and humidity (approx. 65% RH) for at least 4 hours prior to testing.

b) Cut 140 mm diameter circle of a standard abrasive substrate.

c) Cut 38 mm diameter circle of test substrate.

d) Cut 38 mm diameter circle of standard foam padding.

Cutting Procedure a) Place substrate face down on the black Martindale cutting board.

b) Pull out the silver safety knob of the side of the circle cutter and twist to lock the cutter in the open position.

c) Position the circle cutter on the substrate sample.

d) Hold the cutter down and firmly twist the black Martindale handle at least 2 revolutions to cut the substrate.

II Test Procedure (Dry)

a) Place the roller drivers in the PARK position by lowering the lid and pressing the orange button.

b) Lift the lid and check that the tree drivers are in the C position for abrasion.

c) Remove the clamp ring from each of the size abrading tables.

d) Place a single felt pad followed by a piece of abrasive cloth face up on each abrading table.

e) Put the abrading table weight on top of the abrasive cloth.

f) Tighten the clamp ring over the felt and the abrasive cloth with a clockwise twist. Remove the abrading table weight. Repeat for all six positions for the maximum capacity or use lesser positions for smaller number of samples. All surfaces should be smooth.

g) Weigh each sample by using an analytical balance capable of measurement to at least 4 decimal places.

h) Unscrew the sample holder and place in the sample holder clamp. Remove the insert and lay the substrate sample face down in the holder.

i) Place a piece of foam over the sample, top with the insert and re-screw the body of the sample holder.

j) Place the sample holders on the abrading table, matching the holder number with the appropriate counter.

k) Lower the lid and attach each sample by inserting the sample holder spindle with the O-ring inside the sample holder.

l) Place the 9 kPa weight on the head of the spindles and lock it in place.

m) Zero all counters.

n) Adjust and set for the appropriate number of abrasion cycles.

o) Initiate abrading cycles.

p) When test cycles completed, remove and weigh each sample.

III Test Procedure (Wet)

a) Soak felt pads in distilled water.

b) Place the roller drivers in the PARK position by lowering the lid and pressing the orange button.

c) Lift the lid and check that the tree drivers are in the C position for abrasion.

d) Remove the clamp ring from each of the size abrading tables.

e) Place a single wet felt pad followed by a piece of abrasive cloth face up on each abrading table. Because of anti-shrinkage, it may be necessary to gently stretch the felt pad so that it covers the entire abrading platform.

f) Put the abrading table weight on top of the abrasive cloth.

g) Tighten the clamp ring over the felt and the abrasive cloth with a clockwise twist. Remove the abrading table weight. Repeat for all six positions for the maximum capacity or use lesser positions for smaller number of samples. All surfaces should be smooth.

h) To each of the abrasive cloths add 2 mL of distilled water.

i) Weigh each sample by using an analytical balance capable of measurement to at least 4 decimal places.

j) Unscrew the sample holder and place in the sample holder clamp. Remove the insert and lay the substrate sample face down in the holder.

k) Place a piece of foam over the sample, top with the insert and re-screw the body of the sample holder.

l) Add ½ mL distilled water to the surface of the sample.

m) Place the sample holders on the abrading table, matching the holder number with the appropriate counter.

n) Lower the lid and attach each sample by inserting the sample holder spindle with the O-ring inside the sample holder.

o) Place the 9 kPa weight on the head of the spindles and lock it in place.

p) Zero all counters.

q) Adjust and set for the appropriate number of abrasion cycles.

r) Initiate abrading cycles.

s) Using a micro-pipette to apply additional water to the abrading surface if the number of cycles exceeds 1500.

t) Rinse samples and allow to dry over night.

u) When drying completed weigh each sample.

IV Substrate Weight Loss:

$$\text{weight loss} = \frac{\text{initial sample weight abraded sample weight}}{\text{initial sample weight}} \times 100$$

V Increase of Abrasion Resistance ($AR$):

$$\text{increase } AR = \frac{\text{\% weight loss of control} - \text{\% weight loss of test}}{\text{\% weight loss of control}} \times 100$$

For the purposes of the present invention, the control for anti-abrasion is treatment of fabric with a like concentration of formaldehyde only solution under the same application, curing and drying conditions.

Anti-shrinkage

Anti-shrinkage relates to the property of fabric not to contract and therefore provide a substrate with reduced dimensions. Shrinkage is determined by applying American Association of Textile Chemists and Colorists (AATCC) Method 135-1995 or Method 150-1995. The Anti-shrinkage benefit is defined as fabric having an Anti-shrinkage Rating (SR) of less than about 10% after 1 washing. Other embodiments provide a rating of less than about 5% after 1 machine washing. Yet other embodiments of the present invention provide the substrate with a SR of less than about 4% or 3% after 1 washing. Yet another embodiment provides a SR of less than 1% after a single washing.

The present invention further relates to a number of embodiments that provide a substrate having the 10%, 5%, 4%, 3% and 1% SR benefits after the substrates have been undergone at least 5 machine washings.

Anti-yellowing

Anti-yellowing relates to the property of a substrate not to loose it's color or hue due to the change in optical properties of the fabric which comprises said substrate. The following is a non-limiting example of a procedure for determining the anti-yellowing effect of the systems of the present invention.

Anti-yellowing can be determined by any suitable means, for example, American Association of Textile Chemists and Colorists (AATCC) Method 110-1995 which is measures the whiteness and tint of textiles. For the purposes of the present invention a change in CIE value of 2 is considered to be a significant difference, a CIE change of 5 units is a profoundly different change. The anti-yellowing properties are typically determined relative to both untreated fabric and fabric which is treated with a crosslinking agent only, inter alia, formaldehyde.

SYSTEMS OF THE PRESENT INVENTION

The present invention relates to a system for treating fabric fibers resulting in at least three of the hereinabove defined fabric benefits. The system of the present invention involves application to said fabric fibers of a composition comprising:

a) formaldehyde;

b) polyethylene glycol having a molecular weight of from about 700 gm/mol to about 2500 gm/mol; and c) an acid catalyst.

The amount of formaldehyde, polyethylene glycol, and catalyst all are dependent upon the type of fiber to be treated, the amount of relative benefit desired by the formulator and compatibility of the present systems or process to other steps in forming the final fabric.

In one embodiment of the present invention 100% cotton fibers are treated with the composition. In this embodiment, formaldehyde is delivered as a 37% by weight, solution in methanol/water and the solution volume is adjusted such that from about 2% to about 12% by weight, of said solution comprises formaldehyde. In a variation of this embodiment, said composition comprises from about 4% to about 8% by weight, of formaldehyde.

Another embodiment of the present invention provides the hereinabove defined benefits to viscose rayon. In this embodiment, the composition comprises from about 10% to about 30% by weight, of formaldehyde. Variations of this embodiment include formaldehyde in a range of from about 14% to about 22% by weight.

Other embodiments may employ similar or identical ranges of formaldehyde in the benefit delivering composition.

When determining the amount of polyethylene glycol (PEG) to provide for the present system or process, the amount of fabric to be treated is the primary consideration. In one embodiment of the present invention, from about 0.1% to 15% by weight, of PEG is applied per unit mass of the fabric. The formulator will realize that the amount of PEG uptake and the efficiency thereof will predicate the amount of PEG to be delivered per unit mass of fiber. In this embodiment, there is an assumption that from about 60% to about 100% by weight, of PEG will be taken up by the fabric. Therefore, in embodiments wherein less than this range of PEG is absorbed, the formulator can adjust the amount of PEG present in the composition.

In one embodiment, where PEG uptake is greater than about 80%, from about 1% to about 10% by weight, of said composition comprises PEG. In more efficient uptake embodiments, the amount of PEG may range from about 2% to about 8% by weight, of a composition.

For the purposes of the present invention the term polyethylene glycol refers to polymers of ethylene glycol wherein the average molecular weight is from about 700 gm/mol to about 2500 gm/mol, however, in one embodiment the range is reduced from about 700 gm/mol to about 1900 gm/mol. The term "molecular weight", therefore, refers to a molecular weight average ($M_w$) of all PEG's, which comprise said polymers. Depending upon the choice of the formulator, the range of molecular weights which are contained in any PEG used for the present invention, can be broader or narrower in range. In several embodiments, PEG having a molecular weight of 1000 gm/mol is most efficient for delivering the fabric benefits. The PEG's of the present invention do not comprise any units which are branched, inter alia, poly(2-propylene)glycol. EO/PO/EO and PO/EO/PO co-polymers, for example Pluronics® available ex BASF are not suitable PEG's according to the present invention.

Embodiments of the present invention include employing the following ranges of PEG's having molecular weight of from about 800 gm/mol to about 1500 gm/mol; PEG's having a molecular weight of from about 900 gm/mol to about 1200 gm/mol, as well as the PEG having a particular molecular weight, inter alia, 800 gm/mol, 1000 gm/mol, 1200 gm/mol and the like.

Another element of the present invention is an acid catalyst. From embodiment to embodiment of the present invention, predicated on the amount of benefit to be delivered, the type of fiber to be treated, and the preceding as well as subsequent processing steps, the formulator has a wide range of acid catalysts which are compatible with delivering the benefits of the present invention.

In one embodiment, the composition comprises from 1% up to about 12% by weight, of a catalyst in the final composition applied to fabric fiber. However, other embodiments provide a range of catalyst amount, for example, from about 1% to about 9% by weight, of catalyst. Typically, catalysts are delivered as solutions comprising from about 20% to about 50% by weight, of catalyst. In one embodiment, magnesium chloride is provide as a 40% by weight, aqueous solution which after dilution in the composition, is present at a level of about 5% by weight, of the composition which is used to treat fabric fiber.

Suitable catalysts include mineral acids, salts of strong acids, organic acids, ammonium salts, alkylamine salts, and the like. Non limiting examples of acid catalysts include hydrochloric acid, sulfuric acid, nitric acid, phosphoric acid, boric acid, oxalic acid, tartaric acid, citric acid, malic acid, glycolic acid, methoxyacetic acid, chloroacetic acid, trifluoroacetic acid, lactic acid, 3-hydroxybutyric acid, methanesulfonic acid, ethanesulfonic acid, hydroxymethanesulfonic acid, benzenesulfonic acid, p-toluenesulfonic acid, cyclopentanetetracarboxylic acid, butanetetracarboxylic acid, tetahydrofurantetracarboxylic acid, nitrilotriacetic acid, ethylenediaminetetraacetic acid, sodium bisulfate, sodium dihydrogen phosphate, disodium hydrogen phosphate, ammonium chloride, ammonium nitrate, ammonium sulfate, ammonium bisulfate, ammonium dihydrogen phosphate, diammonium hydrogen phosphate, aluminum chlorohydroxide, aluminum chloride, aluminum nitrate, aluminum sulfate, magnesium chloride, magnesium nitrate, magnesium sulfate, zinc chloride, zinc nitrate, and zinc sulfate.

One embodiment of the present invention employs the magnesium chloride/citric acid catalyst FREECAT® LF while another suitably comprises an aluminum chloride/magnesium chloride catalyst FREECAT® 9 both of which are available ex B. F. Goodrich. In other embodiments of the present invention, quaternary ammonium catalysts, inter alia, choline chloride are suitable for use.

The system or process of the present invention may utilize compositions which comprise additional adjunct ingredients. One embodiment of the present invention includes a non-ionic surfactant to assist in stabilizing said composition. When present, said nonionic surfactant comprises from about 0.01% to about 1% by weight, of said composition. In another embodiment the nonionic surfactant is present at a level of from about 0.1% to about 0.5% by weight, of said composition.

PROCESS

The present invention further relates to a process for providing a substrate which comprises fabric fiber, and which substrate has at least three enhanced fabric properties as described herein below.

Accordingly, the present invention relates to a process for providing at least three enhanced benefits to a fabric fiber comprising substrate, said benefits selected from the group consisting of:

i) durable press;

ii) hand feel;

iii) anti-abrasion;

iv) anti-shrinkage; and v) anti-yellowing;

wherein said process comprises the steps of:

A) treating a fabric fiber comprising substrate with a composition comprising:

a) formaldehyde;

b) polyethylene glycol having a molecular weight of from about 700 gm/mol to about 2500 gm/mol;

c) an acid catalyst; and

B) curing said composition on the surface of said substrate.

Other optional steps may be added to the present process as deemed necessary and desirable by the formulator to achieve one or more other benefits or to remain compatible with the overall process of providing the final substrate.

The process may be extended to operate within other fiber preparing steps, providing a process which comprises the steps of:

A) optionally sizing a fabric;

B) optionally cutting and forming said fabric;

C) optionally forming a fabric fiber comprising substrate;

D) treating said fabric fiber comprising substrate with a composition comprising:

a) formaldehyde;

b) polyethylene glycol having a molecular weight of from about 700 gm/mol to about 2500 gm/mol;

c) an acid catalyst;

E) curing said composition on the surface of said substrate; and

F) optionally adding a softener.

EXAMPLE 1

The following describes the system for providing at least three enhanced benefits to a substrate comprising fabric. The substrate is vicose rayon. The composition, which is used to treat said substrate comprises:

a) 56.37 g of a 37% by weight, solution of aqueous formaldehyde, resulting in 20.86 gm formaldehyde and 35.51 gm water;

b) 15.66 g of a 27.3% by weight, solution of aluminum chloride/magnesium chloride catalyst FREECAT® 9, resulting in 4.28 g catalyst and 11.38 g water;

c) 0.31 gm Tergitol TMN-6 (2,6,8-trimethyl-4-nonyloxypolyethyleneoxy ethanol);

d) 15.66 g PEG 1000 (polyethylene glycol having an average $M_w$ of about 1000 g/mol);

e) 132 g deionized water.

The applied solution comprises:

| | % weight |
|---|---|
| formaldehyde | 9.5 |
| catalyst | 1.95 |
| surfactant | 0.14 |
| PEG | 7.1 |
| water | 81.31 |

The following system of the present invention assumes a wet pick-up of 70.25% by weight, of said solution thereby delivering 5% of PEG. The composition is applied to said fabric using a Mathis 2-Roll Laboratory Padder horizontal or vertical, Type HVF-500. The drying oven is a Mathis Labdryer, Type LTE. Padder is set at a pressure of 5 bars at a rate of 1.5 meters of fabric per minute through the solution bath in a horizontal position. The oven temperature is set at 150° C. and the curing time is 4 minutes at a fan speed of 2000 rpm.

Evaluation

The following demonstrates the procedures for determining whether the enhanced benefits of the present invention have been achieved. This composition is not a preferred embodiment of the present invention, but is only provided herein solely to demonstrate the procedure for determining if the criteria for providing a particular benefit has been achieved.

Vicose Rayon is treated with a treatment solution comprising:

| | % weight |
|---|---|
| formaldehyde | 6.7 |
| catalyst | 1.4 |
| PEG | 10 |
| water | 79.1 |

The substrate is treated in a manner in which for sample A, 2% by weight of fabric, of PEG is absorbed and for sample B, 5% by weight of fabric, of PEG is absorbed. A control (untreated substrate) and a sample exposed only to formaldehyde is prepared.

The following are the results for the first fabric benefit, durable press, after one wash.

| | DP rating |
|---|---|
| Control | 1.5 |
| HCHO only | 3.7 |
| 2% PEG take up | 3.7 |
| 5% PEG take up | 3.5 |

The following are the results for the second fabric benefit, anti-shrinkage, after one wash.

| | % anti-shrinkage |
|---|---|
| Control | 8.0 |
| HCHO only | 0.6 |
| 2% PEG take up | 0.3 |

The following are the results for the third fabric benefit, anti-abrasion, after one wash.

| | % loss/cycle |
|---|---|
| Control | 0.7 |
| HCHO only | 7.0 |
| 2% PEG take up | 3.0 |
| 5% PEG take up | 2.0 |

The following are the results for the fourth fabric benefit, whiteness, after one wash.

| | Δ CIE |
|---|---|
| Control | — |
| HCHO only | −3.85 |
| 2% PEG take up | −1.42 |
| 5% PEG take up | +1.47 |

Summary

As can be seen, treatment of fabric with formaldehyde only can result in an enhancement of one or two properties, for example, durable press over a standard untreated control. However, treatment alone with formaldehyde greatly increases other substrate negative parameters, for example, anti-abrasion. In order to achieve the desired at least three increased fiber benefits, a composition according to the present invention must be utilized.

Considering the 2% PEG take up leg of the above testing, except for anti-yellowing, three parameters, durable press, anti-shrinkage, and anti-abrasion are increased. Durable press and anti-shrinkage are measured relative to untreated fabric, whereas, anti-abrasion is measured relative to formaldehyde treatment. The native material (untreated) will necessarily be more robust against anti-abrasion. This is due to the fact that any treatment system will degrade to some degree the core structure of any fabric exposed to an acid catalyzed process.

However, for an anti-yellowing benefit to be achieved, a 5% take up of the test solution must be realized. It is, therefore, necessary that the formulator adjust the solution concentrations, the uptake rate, etc. in order to achieve all of the fabric enhancement benefits desirable.

What is claimed is:

1. A process for providing at least three enhanced benefits to a fabric fiber-comprising substrate, said benefits selected from the group consisting of:

i) durable press, as compared with untreated fabric fiber-comprising substrate;

ii) hand feel, as compared with untreated fabric fiber-comprising substrate;

iii) anti-abrasion, as compared with fabric fiber-comprising substrate treated with formaldehyde and catalyst in the absence of polyethylene glycol;

iv) anti-shrinking, as compared with untreated fabric fiber-comprising substrate; and v) anti-yellowing, as compared with at least one of untreated fabric fiber-comprising substrate and fabric fiber-comprising substrate treated with formaldehyde and catalyst in the absence of polyethylene glycol;

wherein said process comprises the steps of:

A) treating a fabric fiber-comprising substrate with a composition comprising:

a) formaldehyde;

b) polyethylene glycol having a molecular weight of from about 700 gm/mol to about 2500 gm/mol; and c) an acid catalyst; and B) curing said composition on the surface of said substrate.

2. A process according to claim 1 wherein said composition comprises polyethylene glycol having a molecular weight of from about 800 gm/mol to about 1900 gm/mol.

3. A process according to claim 2 wherein said composition comprises polyethylene glycol having a molecular weight of from about 900 gm/mol to about 1200 gm/mol.

4. A substrate according to claim 3 wherein said composition comprises polyethylene glycol having a molecular weight of about 1000 gm/mol.

5. A process according to claim 1 wherein said composition comprises from about 2% by weight, of formaldehyde.

6. A process according to claim 5 wherein said composition comprises from about 4% to about 8% by weight, of formaldehyde.

7. A process according to claim 1 wherein said composition comprises from about 1% to about 10% by weight, of polythylene glycol.

8. A process according to claim 7 wherein said composition comprises from about 2% to about 8% by weight, of polyethylene glycol.

9. A process according to claim 1 wherein said composition comprises from about 1% to about 12% by weight, of said catalyst.

10. A process according to claim 9 wherein said composition comprises from about 1% to about 9% by weight, of said catalyst.

11. A process according to claim 10 wherein said composition comprises about 5% by weight, of said catalyst.

12. A process according to claim 1 wherein said catalyst is selected from the group consisting of mineral acids, salts of strong acids, organic acids, ammonium salts, alkylamine salts, and mixture thereof.

13. A process according to claim 12 wherein said catalyst is magnesium chloride, aluminum chloride, citric acid, or mixture thereof.

14. A process according to claim 1 wherein said composition further comprises from 0.01% to 1% by weight, of nonionic surfactant.

15. A process according to claim 1 having a durable press benefit of about 3 after 1 washing.

16. A process according to claim 1 having a durable press benefit of about 3 after 5 washings.

17. A process according to claim 1 wherein said fabric has a Anti-shrinkager Rating of less than 10% after 1 washing.

18. A process according to claim 1 wherein said fabric has a Anti-shrinkage Rating of less than 5% after 5 washing.

19. A process for providing at least three enhanced benefits to a fabric fiber-comprising substrate, said benefits selected from the group consisting 0f:

i) durable press, as compared with untreated fabric fiber-comprising substrate;

ii) hand feel, as compared with untreated fabric fiber-comprising substrate;

iii) anti-abrasion, as compared with fabric fiber-comprising substrate treated with formaldehyde and catalyst in the absence of polyethylene and catalyst in the absence of polyethylene glycol;

iv) anti-shrinking, as compared with untreated fabric fiber comprising substrate; and v) anti-yellowing, as compared with at least one of untreated fabric fiber-comprising substrate and fabric fiber-comprising substrate treated with formaldehyde and catalyst in the absence fo polyethylene glycol; wherein said process comprises the steps of:

A. treating a fabric fiber-comprising substrate with a composition comprising:

a) from about 2% to about 12% by weight, of formaldehyde;

b) from about 1% to about 10by weight, of polyethylene glycol c) from about 1% to about 12% by weight, of an acid catalyst; and B. curing said composition on the surface of said of substrate.

20. A process according to claim 19 wherein said composition comprises from about 4% to about 8% by weight, of formaldehyde; from about 2% to about 8% by weight of polyethylene glycol; and from about 1% to about 8% by weight, of polythylene glycol; and from about 1% to about 9% by weight, of said catalyst.

21. A process according to claim 19 wherein said catalyst is selected from the group consisting of mineral acids, salts of strong acids, organic acids, ammonium salts, alkylamine salts, and mixture thereof.

22. A process according to claim 20 wherein said catalyst is magnesium chloride, aluminum chloride chloride, citric acid, or mixtures thereof.

* * * * *

UNITED STATES PATENT AND TRADEMARK OFFICE

CERTIFICATE OF CORRECTION

PATENT NO. : 6,953,485 B2
DATED : October 11, 2005
INVENTOR(S) : Robb R. Gardner et al.

It is certified that error appears in the above-identified patent and that said Letters Patent is hereby corrected as shown below:

Column 12,
Line 36, delete "substrate" and insert -- process --.
Line 40, delete "2% by weight" and insert -- 2% to about 12% by weight --.
Line 46, delete "polythylene" and insert -- polyethylene --.
Lines 61 and 64, delete "mixture" and insert -- mixtures --.

Column 13,
Line 6, delete "Anti-shrinkager" and insert -- Anti-shrinkage --.
Line 8, delete "washing" and insert -- washings --.
Line 11, delete "0f" and insert -- of --.
Lines 18 and 19, delete "polyethylene and catalyst in the absence of".
Line 25, delete "fo" and insert -- of --.

Column 14,
Line 5, delete "10by" and insert -- 10% by --.
Line 6, after "glycol", insert -- having a molecular weight of from about 900 gm/mol to about 1200 gm/mol; and --.
Line 9, delete "said of" and insert -- said --.
Lines 11-16, delete beginning with text "20. A process…" and ending with "...of said catalyst." and insert the following claim:
-- 20. A process according to claim 19 wherein said composition comprises from about 4% to about 8% by weight, of formaldehyde; from about 2% to about 8% by weight, of polyethylene glycol; and from about 1% to about 9% by weight, of said catalyst. --.
Line 20, delete "mixture" and insert -- mixtures --.
Line 22, delete "chloride chloride" and insert -- chloride --.

Signed and Sealed this

Fourth Day of April, 2006

JON W. DUDAS
*Director of the United States Patent and Trademark Office*